United States Patent [19]

Stiff et al.

[11] Patent Number: 4,896,442

[45] Date of Patent: Jan. 30, 1990

[54] TRENCHER APPARATUS

[75] Inventors: Rodney A. Stiff; James R. Warren, both of Bundaberg, Australia

[73] Assignee: Austoft Industries Limited, Queensland, Australia

[21] Appl. No.: 29,745

[22] Filed: Mar. 24, 1987

[30] Foreign Application Priority Data

Mar. 25, 1986 [AU] Australia ..... PH5198

[51] Int. Cl.[4] ..... E02F 5/06

[52] U.S. Cl. ..... 37/86; 180/242

[58] Field of Search ..... 37/86, 87, DIG. 1, DIG. 7, 37/; 180/79, 142, 79.1, 141, 79.3, 135, 242, 244; 280/432, 442, 96

[56] References Cited

U.S. PATENT DOCUMENTS 2,771,958 11/1956 Ball ..... 37/DIG. 7

3,620,333 11/1971 Menzi ..... 37/1 X 3,880,251 4/1975 Clevanger, Jr. et al. ..... 37/86 X 4,034,490 7/1977 Teach ..... 37/86

*Primary Examiner*—David A. Wiecking

*Assistant Examiner*—Moshe I. Cohen

*Attorney, Agent, or Firm*—Dorsey & Whitney

[57] ABSTRACT

A trencher comprising a digger located adjacent the rearward wheels, which pair of wheels are driven hydraulically and which have an open area between them into which the digger may be partially positioned. The forward wheels of the trencher are steerable by use of a self-locking angular adjustment mechanism. A hydraulic circuit which includes a pressure relief valve provides substantially constant pressure on the chain of the digger. A locking mechanism is provided for the forward wheels when initiating the cutting action of the digger.

5 Claims, 5 Drawing Sheets

TRENCHER APPARATUS

INTRODUCTION

This invention relates to a trencher and, more particularly, to a trencher of the self-propelled variety.

BACKGROUND OF THE INVENTION

Trenchers or diggers are known. These trenchers are of the variety wherein they may be ridden by the operator or, alternatively, they may be controlled by an operator from a position not on the trencher as, for example, walking adjacent thereto. All of such known trenchers suffer from various disadvantages which are inherent in the several designs.

In one known trencher, for example, the digger apparatus is located in a position some distance behind the rearward wheels. There is significant force generated on the chain by the digger tools during the operation of the digger. Such force creates a moment on the trencher frame which tends to raise the forward wheels of the trencher off the ground. Such force on the digger tools also produces impact loading which tends to make the machine buck or jerk while under operation. To reduce these problems, weight has been added to the frame which weight, however, can cause the trencher to be unnecessarily heavy. In any event, such added weight is inefficient.

A further problem with known trenchers involves the steering control system. Some known trenchers use a skid type steering system which, because of its jerkiness, can cause difficulties in cutting smooth curves which may be highly desirable for certain applications. Other trenchers use steerable front wheels but such trenchers are usually ridden by an operator where the steering wheel is not left unattended and, therefore, such previous trencher steering systems used in "operator ridden" applications are not self-locking which is desirable in non-riding applications where the steering function may well be left unattended for a certain time.

Yet a further problem in existing trenchers relates to the power or drive wheels. Where the power or drive wheels are not in a position nearest to the digger chain, the drive wheels are not obtaining the maximum downward force benefit from the chain and, therefore, the drive wheels are acting in a less efficient manner.

Yet a further problem relates to the digger or cutting chain. It is desirable, for efficient cutting, that the speed of the cutting chain be maintained at its most desirable revolution rate. When digging through hard dirt or in rocks, for example, the engine speed may well decrease. It is desirable, therefore, to reduce the pressure of the digger chain on the soil so as to bring the engine speed back to its normal rate. Such manual manipulation of the controls, however, is tedious and requires constant monitoring by the operator.

Yet a further problem relates to the inherent tendency of a trencher to be moved by the cutting action of the digger chain when the cutting action into the ground is commenced. The digging action under certain digging conditions can lift the rearward driving wheels off the ground which thereby allows the trencher to be propelled rearwardly creating an unexpected and potentially unsafe situation.

SUMMARY OF THE INVENTION

According to one aspect of the invention, there is disclosed a trencher apparatus comprising a frame, a forward pair of steerable wheels connected to said frame, a rearward pair of wheels, a digging apparatus extending downwardly from a position adjacent said rearward pair of wheels, a steering means, said steering means being self-locking and providing angularly incremental adjustment to said steerable wheels.

According to a further aspect of the invention, there is disclosed a trencher apparatus comprising a frame, a forward pair of steerable wheels connected to said frame, a rearward pair of wheels, a digging apparatus extending downwardly from a position adjacent said rearward pair of wheels, a steering means, said steering means being self-locking and providing angularly incremental adjustment to said steerable wheels.

According to a further aspect of the invention, there is disclosed a trencher apparatus comprising a frame, a forward pair of steerable wheels connected to said frame, a rearward pair of driving wheels connected to said frame, an open area extending between the centre lines of said driving wheels and a digging apparatus extending rearwardly from a position adjacent said rearward pair of wheels and partially within said open area.

According to yet a further aspect of the invention, there is disclosed a digger sensing apparatus comprising digger chain means, first hydraulic drive motor means to power said digger chain means, drive wheel means, second hydraulic drive motor means to power said drive wheel means, pressure sensing means to sense pressure in said first hydraulic drive motor means and fluid diversion means to divert fluid from said second hydraulic drive motor means when said pressure in said first hydraulic drive motor means exceeds a predetermined value.

According to yet a further aspect of the invention, there is disclosed a trencher apparatus comprising a frame, a forward pair of wheels connected to said frame, a rearward pair of wheels, a digger apparatus extending downwardly from a position adjacent said rearward pair of wheels and a locking apparatus to lock said forward pair of wheels.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
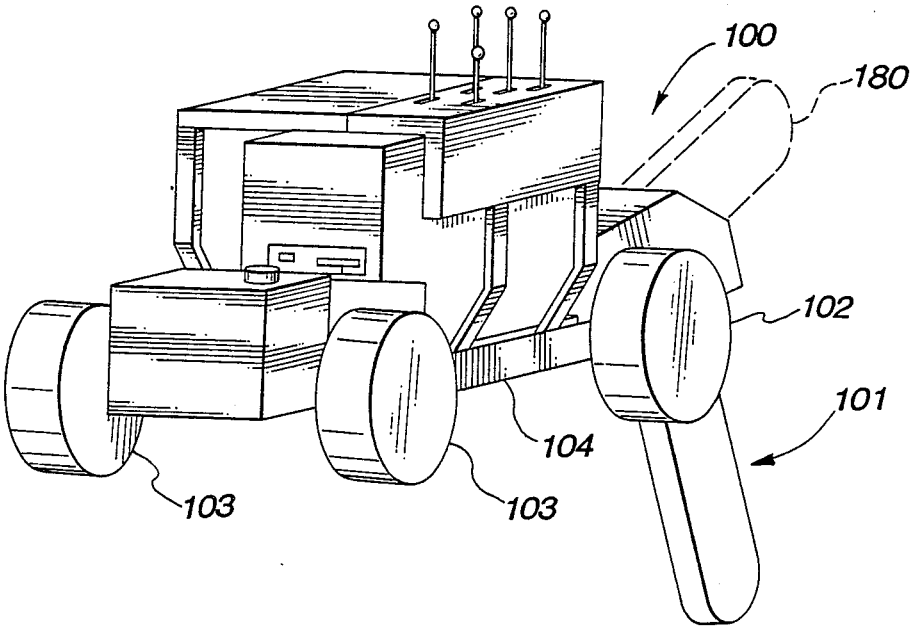
FIG. 1 is an isometric view of a trencher according to the invention.

Referring now to the drawings, a trencher is shown generally at 100 in FIG. 1. It comprises a digger unit generally shown at 101, a pair of rearwardly located drive wheels 102, a pair of forwardly located steering wheels 103 and a frame 104 to which the digger unit 101, the drive wheels 102 and the steering wheels 103 are mounted.

Figure 2:
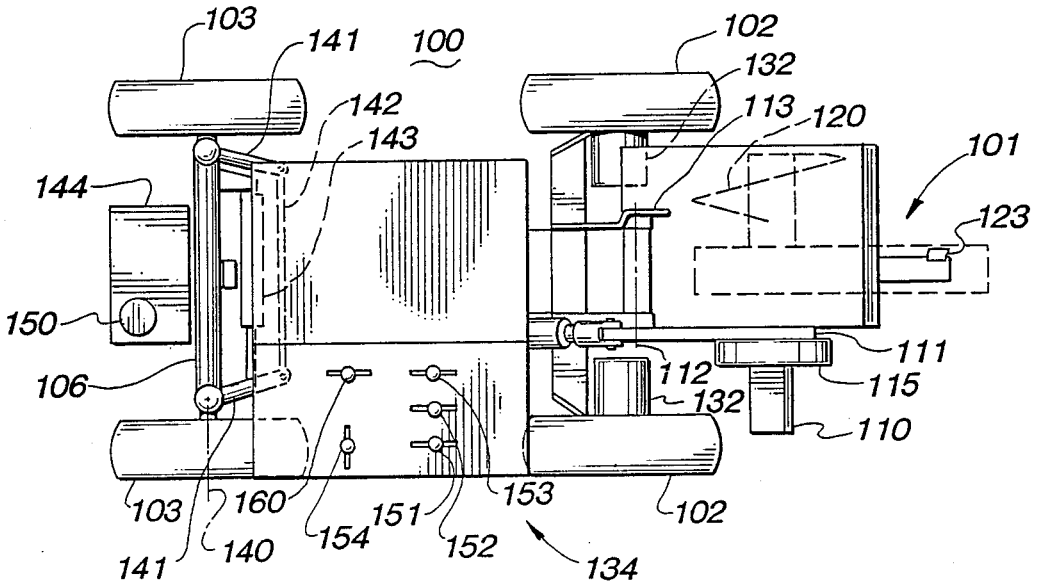
FIG. 2 is a diagramatic plan view of the trencher of FIG. 1.
Figure 3:
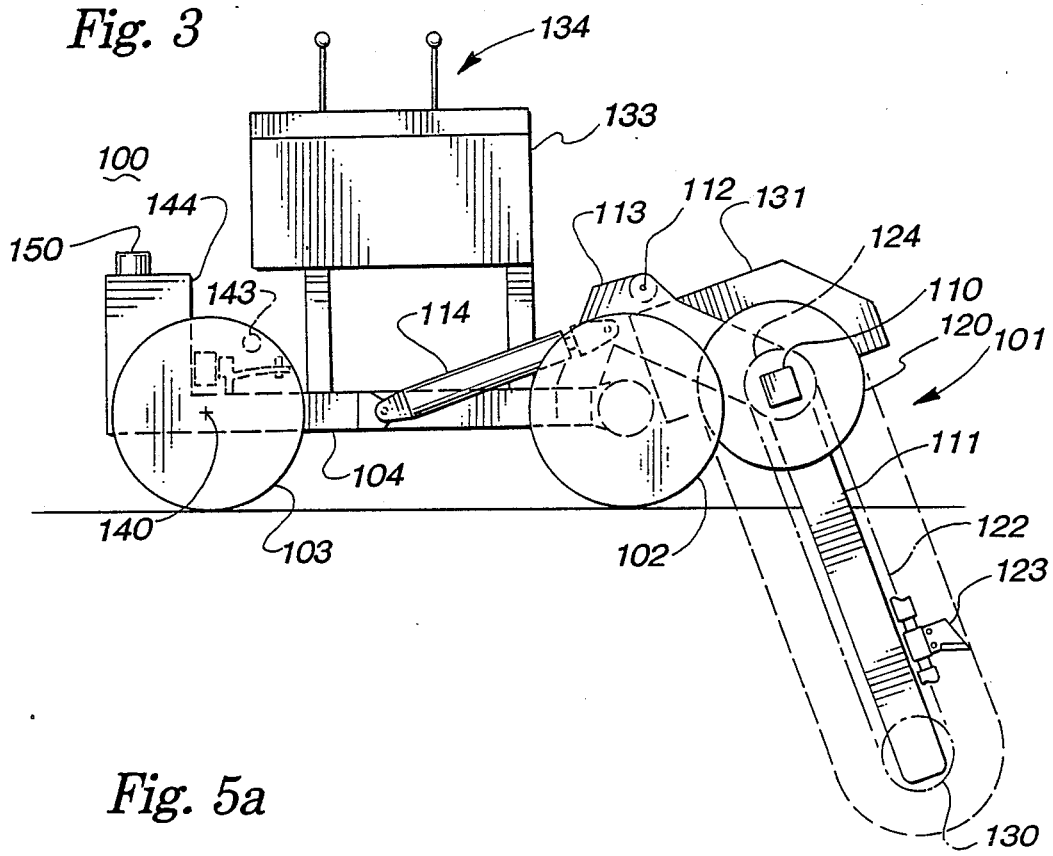
FIG. 3 is a side view of the trencher of FIG. 1.

Reference is now made to FIGS. 2 and 3. The digger unit 101 comprises a hydraulic drive motor 110 and a digger boom 111 to which the drive motor 110 and flywheel 115 are connected. Digger boom 111 is pivoted at 112 where it is connected to frame extension 113. A boom lift or crowd cylinder 114 is connected between frame 104 and digger boom 111 and provides height control for the digger boom 111. Flywheel 115 is operable from hydraulic motor 110 and allows the digger chain 122 to acquire increased momentum under operation.

An earth moving, auger 120 rotates under the control of drive motor 110. Drive motor 110 also powers the digger chain 122 to which are attached a plurality of cutting teeth 123 (only one of which is shown) evenly spaced about the periphery of the digger chain 122 which rotates about the path shown. Digger chain 122 is connected at its upper end to drive sprocket 124 which is run by hydraulic drive motor 110 and at its lower end by an idler pulley 130. A safety cover 131 covers the auger 120 and cutting teeth 123 at the upper end of the digger unit 101 to prevent inadvertent contact with the mechanisms therein.

The drive wheels 102 are each individually powered by hydraulic drive motors 132. As can be seen in the figures, the drive motors 132 allows a substantially open area to exist between the drive wheels 102 into which the digger unit 101 may move when lowered from its raised or transit position.

An engine (not illustrated) is covered by engine cover 133 and the operating controls generally denoted 134 and described hereafter are positioned so as to protrude through the engine cover 133 and to be accessible to the operator of the trencher 100.

A forward pair of steering wheels 103 are independently connected to frame 104 at pivot point 140. Drag links 141 are connected to wheels 103 and a tie rod 142 is connected between the drag links 141 to provide simultaneous movement of the drag links 141 and wheels 103. A linear electric actuator 143, such actuator having a self-locking mechanism such as a worm drive, is connected between the drag links 141 and the frame 104 and provides incremental angular adjustment to the steering wheels 103. A hydraulic fluid tank 144 is mounted to the frame 104 at the forward end and a filler cap 150 allows access to the fluid tank 144.

The operating controls generally shown at 134 include a lever 151 for engagement and disengagement of the digger chain 122, a lever 152 used for controlling the direction of the trencher 100, a lever 153 for providing lift control to the digger unit 101, a lever 154 for providing steering control to the trencher 100, and a lever 160 for providing one of either a high or low speed range to the trencher 100.

Figure 4A:
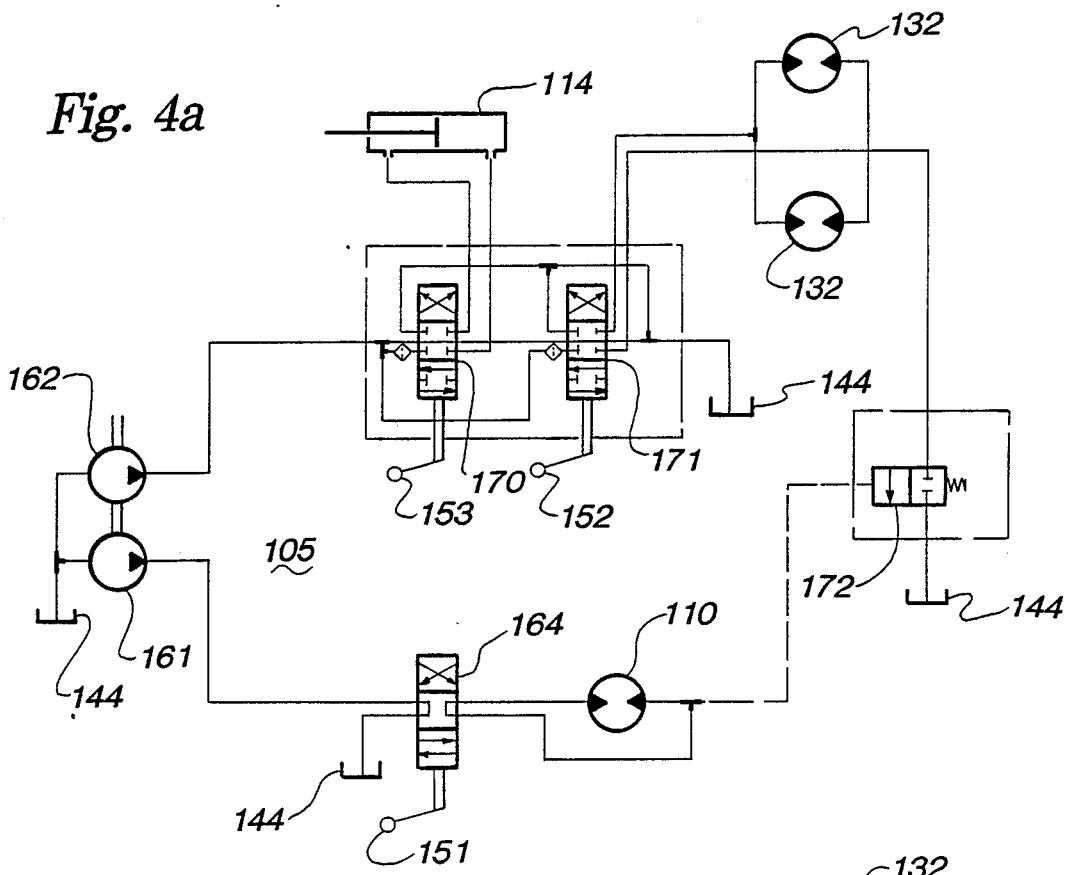
FIG. 4A is a schematic diagram of the hydraulic circuit used to control, among other functions, the cutting pressure of the digger chain.

Reference is now made to FIG. 4 which illustrates a partial schematic diagram of the hydraulic circuit generally described as 105 of the trencher 100. A relatively large hydraulic pump 162 is coupled to a relatively smaller hydraulic pump 161 and fluid is provided to the pumps 161, 162 from the tank 163. Valve 164 is controlled by lever 151 and provides for the engagement and disengagement of the trencher motor 110. A valve 170 is operable by lever 153 and it provides control to the crowd cylinder 114. A valve 171 is operable by lever 152 and provides for forward and reverse movement of the trencher 100 by controlling the direction of fluid flow through hydraulic drive motors 132.

A pressure sensing valve 172 is placed in the hydraulic circuit 105. The pressure sensing valve 172 senses the pressure in hydraulic drive motor 110 for the digger unit 101. In the event the pressure increases beyond the predetermined value for which the valve 172 is calibrated, valve 172 will be operated such that fluid may flow directly through the valve 172 and back to the tank 144. This will reduce the flow of fluid through hydraulic motors 132 and the crowd cylinder 114. This will reduce the ground speed of trencher 100 and the force exerted by the crowd cylinder 114 on the digger boom 111. When the pressure decreases to below that programmed into the calibrated valve, valve 172 will return to the position shown in FIG. 4 and the trencher 100 will resume normal forward operating speed and the crowd cylinder 114 will resume normal contact pressure between the earth and the digger chain 122.

Figure 5A:
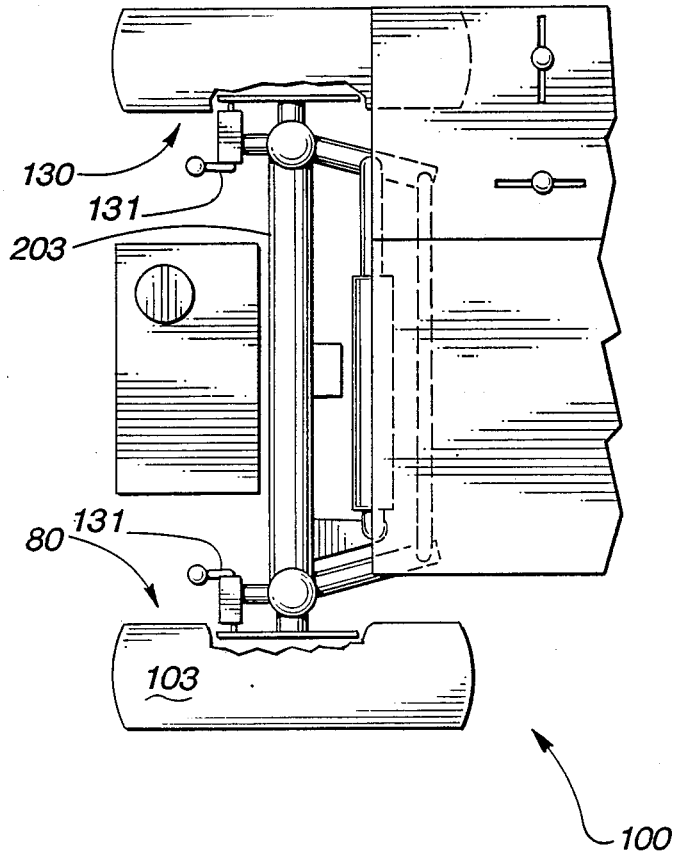
FIG. 5A is a partial diagrammatic plan view of the trencher with the wheel locking apparatus shown in a cutaway view.
Figure 5B:
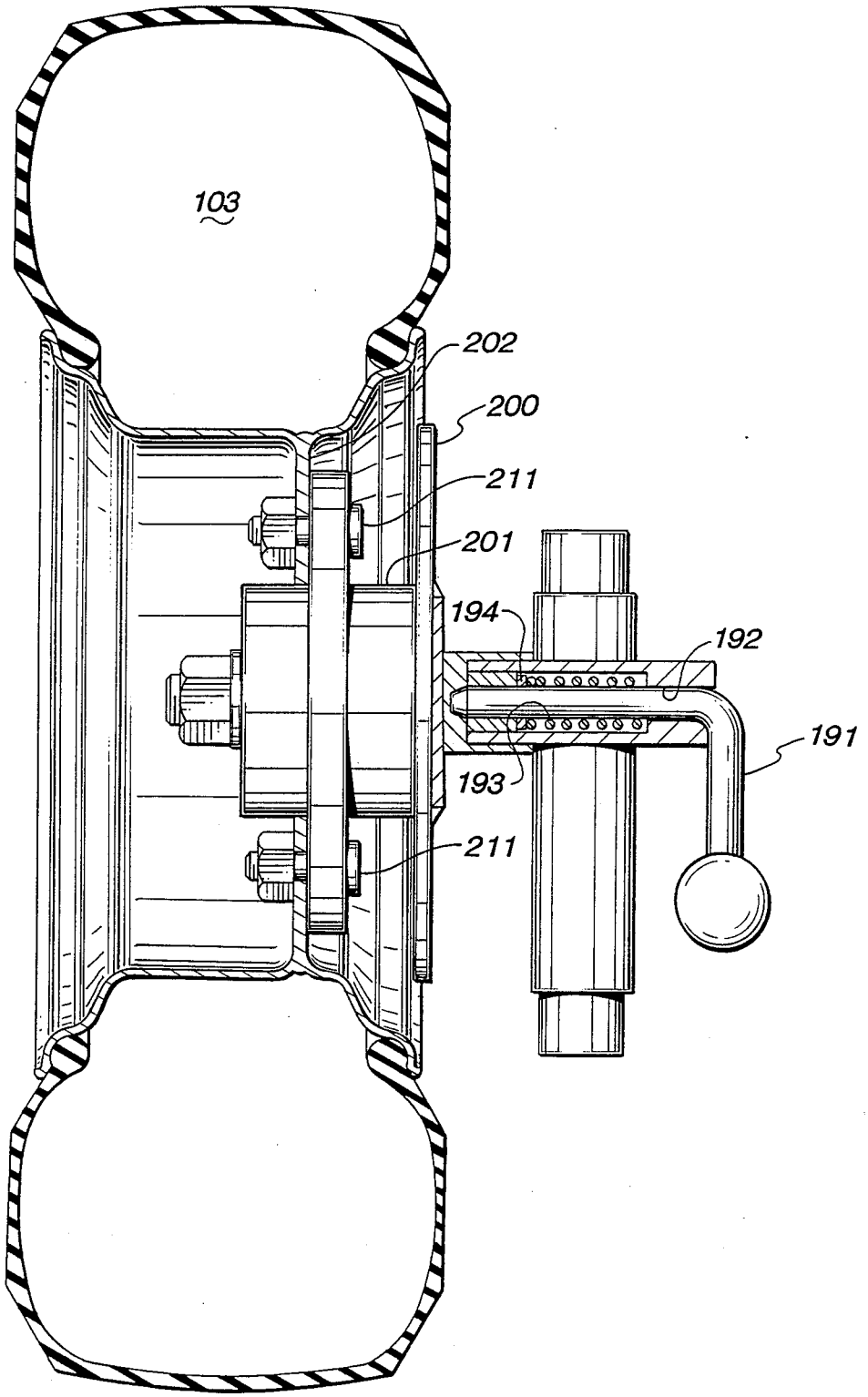
FIG. 5B is an enlarged front view of a forward wheel with the locking apparatus illustrated in greater detail.

The locking mechanisms for the forward wheel 103 of the trencher 100 are generally at 190 in FIG. 5A. The mechanism which is identical for both sides of the trencher 100 comprises a rotatable pin 191 mounted in a complementary cylindrical recess 192. A spring 193 is biased against washer 194 which is connected to pin 191. Thus, the locking pin 191 is continually forced to the left as seen in FIG. 5B. Each assembly is mounted to axle 203.

A locking plate 200 is connected to each hub 201 which is connected to the wheel 202. A series of equidistantly spaced holes 205 (FIG. 5C) are spaced about the periphery of the locking plate 200 which are of a diameter sufficient to allow the entrance of the locking pin 191. Four additional holes 210 are provided to allow access to the hub bolts 211.

OPERATION

It will initially be assumed that the trencher 100 is in the condition illustrated in FIG. 1 except that the digger unit 101 is in the raised or inoperative position illustrated by the dashed lines 180. The hydraulic pumps 161, 162 are operating off the engine (not shown) of the trencher 100. Lever 151 is then activated to commence the rotation of hydraulic drive motor 110 and, therefore, the operation of digger chain 122 and the attached cutting teeth 123. Lever 153 will then be actuated so as to move valve 170 and retract boom lift cylinder 114.

As boom lift cylinder 114 is retracted, digger boom 111 descends until the cutting teeth 123 contact the ground surface and the digger boom 111 gradually lowers into the ground, the earth contacted by the digger teeth 123 traveling to the top of the path of travel of the digger teeth 123 and, thence, to be removed outwardly past the drive wheel 102 by auger 120 as best viewed in FIG. 2. While substantially all of the earth being conveyed outwardly by auger 120 is removed past the drive wheels 102, a portion does interfere with the drive wheels 102. The amount of such dirt is such that it does not interfere with the operation of the trencher 100.

After the digger boom 111 has been lowered to its operating position as illustrated in FIGS. 1 and 3, lever 153 will be in a position such that digger boom 111 remains in a lowered position.

Lever 152 is then activated such that valve 171 allows fluid to flow to drive motors 132 connected to drive wheels 102. The drive wheels 102 rotate and the trenchers 100 moves forwardly or leftwardly under the influence of drive wheels 102 while the digger chain 122 continues to operate and the digging or trenching operation continues.

The trencher 100 is steered by operating lever 154 which controls the linear electric actuator 143. Linear electric actuator 143 is connected between frame 104 and drag link 141 and it extends and retracts under the control of lever 154 to provide the necessary predetermined angular incremental adjustment of the steerable wheels 103 relative to frame 104 so as to steer the trencher 100 while it is moving. The linear electric actuator 143 has a worm drive contained therein and, therefore, it is self-locking and retains the correct steering orientation. That is, the trencher 100 is operated by an operator who may be walking adjacent to the trencher 100. Because of the self-locking feature, the trencher 100 will remain in its correct steering orientation even if lever 154 is left unattended. It is also a feature of the linear electric actuator 143 that the steering wheels 103 may be angularly displaced relative to frame 104 when the engine of the trencher 100 is not operating since, of course, the power required by the actuator 143 is electric.

As the trencher 100 moves leftwardly under the influence of the drive wheels 102, the cutting teeth 123 may encounter rocks or hard soil or the like as a result of which the pressure of the fluid in drive motor 110 will increase in an attempt to keep the digger chain 122 operating at a constant revolution rate. The speed of drive motor 110 will, however, decrease somewhat which is inefficient. To prevent this and to keep the trencher 100 moving at its most efficient speed, pressure sensing valve 172 is provided as well as flywheel 115. As the pressure in drive motor 110 increases due to hard digging and the energy in flywheel 115 is dissipated, the pressure sensing valve 172 will be activated at some point and the fluid from hydraulic motors 132 will be exhausted to the tank 144 rather than circulating in the circuit of the drive motors 132. As such, the flow through the drive motors 132 will decrease and, therefore, the speed of the trencher 100 will also decrease, thereby allowing the speed of the digger chain 122 to increase and return to its most efficient value. As the pressure in drive motor 110 returns to normal, the sensing valve 172 returns to the position indicated and the trencher 100 returns to normal operating speed.

Figure 5C:
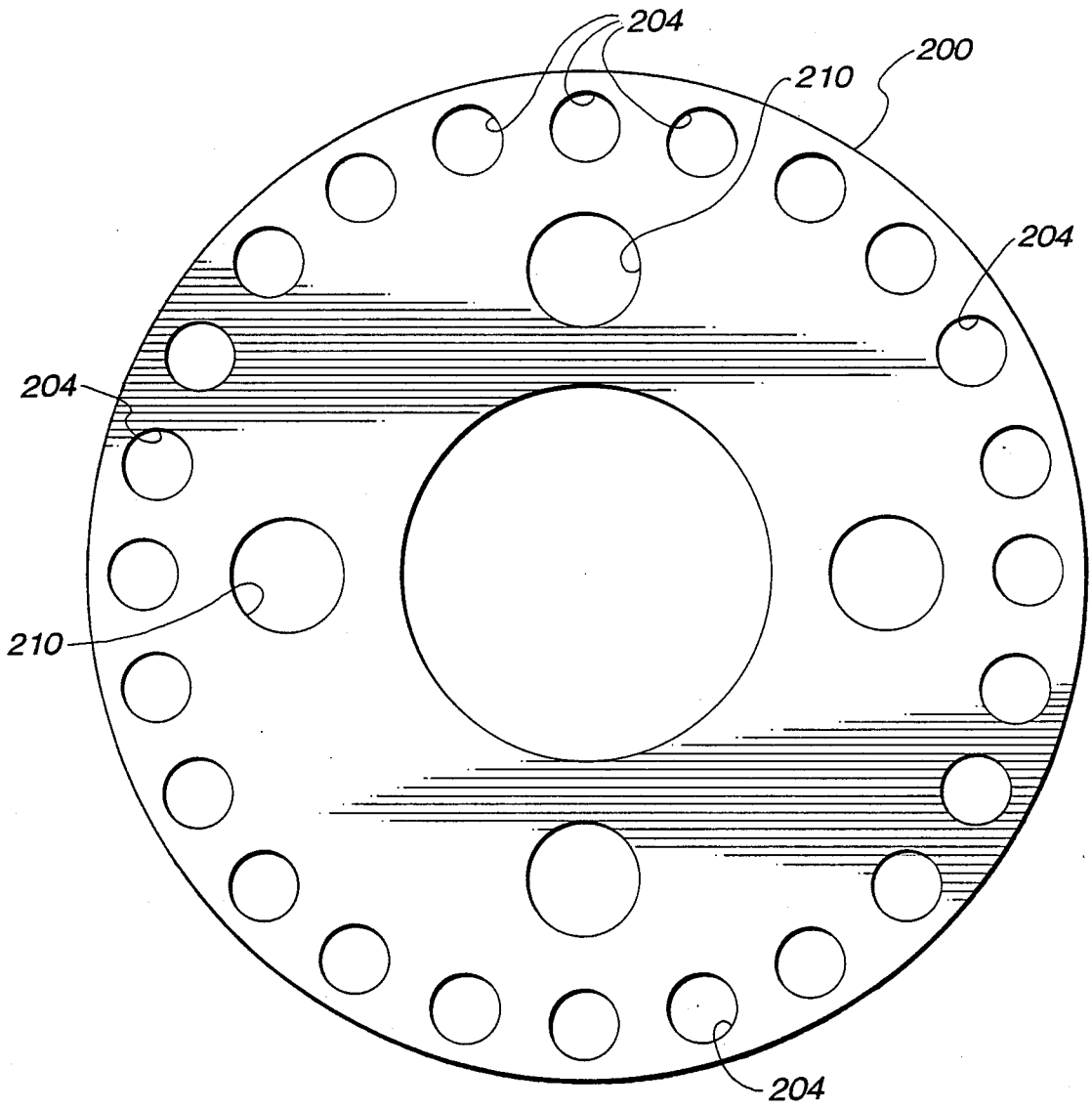
FIG. 5C is an enlarged view of the plate locking wheel hub taken along view C of FIG. 5B.

It will be appreciated that in rocky hard ground, the force on the digger chain 122 may be such as to lift the rear of the trencher 100 and, in particular, the drive wheels 102 off the ground. In such event, the trencher 100 can be moved rearwardly due to the aforementioned unusual force on the digger chain 122. To counteract this force, the locking mechanism 130 illustrated in FIGS. 5A, 5B and 5C is provided.

The pin 191 on each of the steering wheels 103, movably being in the position illustrated in FIG. 5B, is moved upwardly until the handle is conterminous with the recess 192. The spring 193 will move the pin 191 into contact with the locking plate 200 and, upon a small amount of rotation, the pin 191 will move into one of the holes 204 thereby locking the forward wheels 103 and preventing rearward movement of the trencher 100.

When the ground is not rocky or hard and the digging is easier, the handle of the pin 191 is pulled out and rotated downwardly. The forward steering wheels 103 will then be free to rotate in the normal manner.

Figure 4B:
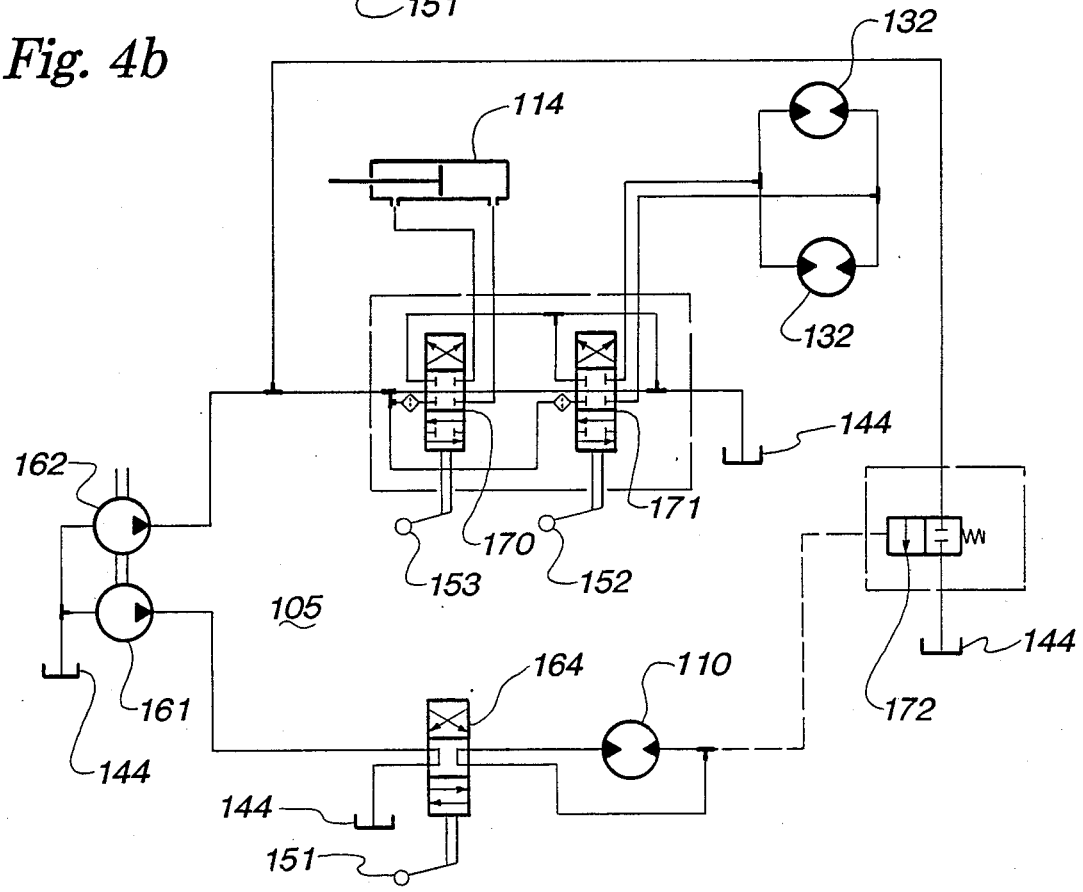
FIG. 4B is a schematic diagram of a second embodiment of the hydraulic circuit of FIG. 4A.

A further embodiment of the hydraulic circuit is illustrated in FIG. 4B. In this embodiment, the dump line for valve 172 is designed such that it controls both the crowd cylinder 114 and the traction motors 132. This is advantageous when, for example, the trencher 100 is stationary and the cutter chain 122 is breaking into the ground and the crowd cylinder 144 is being extended. As the motor 110 approaches stall pressure, the crowd cylinder 114 is stopped automatically by the operation of dump valve 172. The user may also operate the handle 153 and the dump valve 172, by sensing the pressure in trenching motor 100, will extend the cylinder at the required rate.

Many modifications to the apparatus described may be readily made by those skilled in the art and the specific embodiments described should be taken as illustrative only and not as limiting the scope of the invention as defined in the accompanying claims.

I claim:

1. A trencher apparatus comprising:

a. a frame, b. a forward pair of steerable wheels connected to said frame and steerable about a vertical axis, c. a rearward pair of driving wheels, each of said driving wheels being independently driven by a hydraulic motor, d. a digging apparatus extending downwardly from a position adjacent to said driving wheels, said digging apparatus having an earth outlet extending downwardly from a position adjacent to said drive wheels, said earth outlet being located substantially close to one of said driving wheels so as to discharge earth outwardly of said driving wheels, a portion of said earth being discharged to contact one of said driving wheels, e. a steering means to pivot said steerable wheels about said vertical axis, including means rendering said steering means self-locking as against ground forces only while providing uninterrupted capability for angular incremental adjustment to said steerable wheels as a result of steering forces, and f. a locking apparatus to lock said forward pair of wheels against rotation.

2. Trencher apparatus according to claim 1 wherein said means rendering utilizes a worm drive.

3. Trencher apparatus according to claim 2 wherein said steering means is a linear electric actuator.

4. A trencher apparatus as in claim 1 wherein said locking apparatus comprises a locking protuberance and a receiving means, said locking protuberance being mounted on one of said idler wheels or said frame and said receiving means being mounted on the other of said idler wheels or said frame.

5. A trencher apparatus as in claim 1 wherein said locking protuberance is a rotatable pin means mounted on said frame and said receiving means is a locking plate mounted on said wheels.

* * * * *